US007265309B2

(12) United States Patent
Kim et al.

(10) Patent No.: US 7,265,309 B2
(45) Date of Patent: Sep. 4, 2007

(54) BUTTON ASSEMBLY OF CONTROL PANEL ASSEMBLY

(75) Inventors: Jong Min Kim, Changwon-si (KR); Yang Hwan No, Changwon-si (KR); Han Ki Cho, Gimhae-si (KR); Ho Sung Jang, Sachcon-si (KR); Dong Hoon Kang, Busan (KR); Jung Hoon Kang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/140,592

(22) Filed: May 31, 2005

(65) Prior Publication Data

US 2006/0001648 A1 Jan. 5, 2006

(30) Foreign Application Priority Data

Jun. 1, 2004 (KR) ..... 10-2004-0039602

(51) Int. Cl.
*H01H 9/00* (2006.01)

(52) U.S. Cl. ..... 200/341; 200/314

(58) Field of Classification Search ..... 200/341–345, 200/314, 517–520, 5 A, 5 R, 296, 302.1–302; 400/490–491.2, 496

See application file for complete search history.

(56) References Cited

U.S. PATENT DOCUMENTS 4,952,762 A * 8/1990 Koyanagi ..... 200/517
5,003,133 A * 3/1991 Kobayashi et al. ..... 200/5 A
5,749,457 A * 5/1998 Castaneda et al. ..... 200/343
5,788,060 A * 8/1998 Kuroda ..... 200/343
5,927,483 A * 7/1999 Yamada ..... 200/343
5,990,432 A * 11/1999 Kuroda ..... 200/343
6,080,940 A * 6/2000 Rice ..... 200/5 A
6,169,256 B1 * 1/2001 Hanahara et al. ..... 200/5 A
6,239,726 B1 * 5/2001 Saida ..... 340/999
6,414,253 B1 * 7/2002 Kang ..... 200/61.61
6,552,282 B2 * 4/2003 Lewis ..... 200/5 A
6,703,571 B2 * 3/2004 Nishimoto et al. ..... 200/6 A
6,964,532 B1 * 11/2005 Lu ..... 400/490
7,005,588 B2 * 2/2006 Pihlaja ..... 200/5 A
7,015,897 B2 * 3/2006 Tsao ..... 345/168

* cited by examiner

*Primary Examiner*—Michael A Friedhofer
*Assistant Examiner*—Lisa Klaus
(74) *Attorney, Agent, or Firm*—McKenna Long & Aldridge LLP

(57) ABSTRACT

A button assembly of a control panel assembly, which includes buttons each enabling execution of a selected operation of a drum washing machine when pressed, is disclosed. The button assembly includes a control panel provided with a plurality of button holes, a printed circuit board fixedly mounted to a rear surface of the control panel, a vertical rib attached to the control panel, a plurality of vertically-arranged horizontal ribs each having one end connected to the vertical rib, a plurality of buttons each connected to the other end of an associated one of the horizontal ribs, and slidably fitted in an associated one of the button holes, and flow guides each adapted to guide water, penetrating an associated one of the button holes, downward along a predetermined flow path.

20 Claims, 8 Drawing Sheets

BUTTON ASSEMBLY OF CONTROL PANEL ASSEMBLY

This application claims the benefit of the Korean Patent Application No. 2004-39602, filed on Jun. 1, 2004, which is hereby incorporated by reference as if fully set forth herein.

BACKGROUND OF THE INVENTION

1. Field of the Invention

The present invention relates to a control panel assembly mounted to an electric home appliance such as a drum washing machine, and more particularly, to a button assembly of such a control panel assembly, which has a structure capable of guiding, to a desired position, water penetrating the interior of an electric home appliance when a button included in the button assembly is pressed.

2. Discussion of the Related Art

Generally, a control panel assembly, which includes buttons to enable diverse functions, is mounted to an electric home appliance such as a washing machine, a drum washing machine, or a drying machine. Although such a control panel assembly is applicable to various electric home appliances, the following description will be given only in conjunction with a control panel assembly applied to a drum washing machine.

FIG. 1 is a perspective view schematically illustrating the outer appearance of a conventional drum washing machine. As shown in FIG. 1, the conventional drum washing machine includes a cabinet 10 which defines the outer appearance of the drum washing machine, and a door 50 mounted to an opened front wall of the cabinet 10 to allow clothing to be put into the interior of the drum washing machine through the front wall of the cabinet 10. The drum washing machine also includes a tub (not shown) disposed in the cabinet 10 to contain washing water, and a drum (not shown) rotatably disposed in the tub (not shown) to carry out a washing function.

Meanwhile, a control panel assembly is mounted to an upper portion of the front wall of the cabinet 10, in order to control the drum washing machine to perform a selected operation. The control panel assembly includes a plurality of buttons for enabling diverse control operations for the drum washing machine, respectively.

FIG. 2 is an exploded perspective view illustrating the control panel assembly included in the above-mentioned conventional drum washing machine. As shown in FIG. 2, the control panel assembly includes a printed circuit board (PCB) 40 provided with a certain circuit, a control panel 20 which covers the PCB 40, and is provided with a plurality of button holes 21, and a button assembly 30 attached to an rear surface of the control panel 20, and includes a plurality of buttons 31 protruded through the button holes 21, respectively.

In addition to the buttons 31, the button assembly 30 includes a vertical rib 32 attached to the rear surface of the control panel 20, and a plurality of vertically-arranged horizontal ribs 33 each having one end connected to the vertical rib 32. Each of the buttons 31, which is protruded through an associated one of the button holes 21, is connected to the other end of an associated one of the horizontal rib 33. A fastening hole 30*a* is provided at the vertical rib 32. A screw is fastened to the rear surface of the control panel 20 through the fastening hole 30*a*, so as to attach the button assembly 30 to the rear surface of the control panel 20.

Referring to FIG. 3, which is a sectional view illustrating the attached state of the control panel 20, each button 31 has a convex structure such that the button 31 has a portion forwardly protruded through the associated button hole 21. Each button 31 also has a protrusion extending from a rear surface of the button 31 to a predetermined length.

The PCB 40 includes a plurality of key pads 41 arranged on the PCB 40 at positions respectively corresponding to the protrusions 34 of the buttons 31. Each key pad 41 is connected to a microcomputer (not shown) to send to the microcomputer a key input for execution of a predetermined operation of the drum washing machine when the key pad 41 is pressed. Accordingly, when a selected one of the buttons 31 is pressed, the corresponding key pad 41 is pressed, thereby enabling the microcomputer (not shown) to control the drum washing machine to perform an operation associated with the pressed button 31.

However, the above-mentioned conventional control panel assembly has a drawback. That is, if the user presses a selected one of the buttons 31 using his finger under the condition in which the finger is wet, water on the finger may penetrate the interior of the control panel 20 via the button hole 21 corresponding to the pressed button 31. In this case, the water, having penetrated along the button hole 21, may flow to the immediately lower button 31 or to the inner bottom surface of the control panel 20, so that the water may splash. In severe cases, the splashed water may splash up to the PCB 40.

For example, water penetrating the button hole 21 corresponding to the button 31 arranged at an uppermost position a may be quickly dropped without any resistance to the button 31 arranged at a position b, c, or d downwardly spaced apart from the uppermost position a by a distance causing the dropped water to splash, as shown in FIG. 2. Also, the water may be directly dropped to the inner bottom surface of the control panel 20. In either case, the dropped water splashes naturally. In this case, the splashed water may come into contact with the PCB 40. When such a phenomenon occurs during operation of the drum washing machine, the circuit of the PCB 40 may be short-circuited or opened, thereby causing the drum washing machine to malfunction or fail completely.

SUMMARY OF THE INVENTION

Accordingly, the present invention is directed to a button assembly of a control panel assembly that substantially obviates one or more problems due to limitations and disadvantages of the related art.

An object of the present invention is to provide a button assembly of a control panel assembly which is capable of guiding water penetrating button holes of the control panel assembly to slowly and sequentially flow down along buttons extending through the button holes, without being quickly dropped from the buttons, and thus, without splashing.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a button assembly of a control panel assembly comprises: a control panel provided with a plurality of button holes; a printed circuit board fixedly mounted to a rear surface of the control panel; a vertical rib attached to the control panel; a plurality of vertically-arranged horizontal ribs each having one end connected to the vertical rib; a plurality of buttons each connected to the other end of an associated one of the horizontal ribs, and slidably fitted in an associated one of the button holes; and flow guides each adapted to guide water, penetrating an associated one of the button holes, downward along a predetermined flow path.

Each flow guide may be arranged around an associated one of the buttons to surround the associated button, and has a plate-shaped structure.

Vertically-adjacent ones of the flow guides may be vertically spaced apart from each other by a predetermined distance.

Each flow guide may comprise a plate-shaped body, and a pair of rectangular auxiliary plate portions respectively connected to upper and lower ends of the plate-shaped body.

Each flow guides may comprise a plate-shaped body, a rectangular upper auxiliary plate portion connected to an upper portion of the plate-shaped body, and a lower auxiliary plate portion connected to a lower portion of the plate-shaped body. The lower auxiliary plate portion has one end having a round surface.

The plate-shaped structure of each flow guide may have a rectangular shape, a circular shape, an oval shape, or a diamond shape.

In another aspect of the present invention, a button assembly of a control panel assembly comprises: a control panel provided with a plurality of button holes; a printed circuit board fixedly mounted to a rear surface of the control panel; a vertical rib attached to the control panel; a plurality of vertically-arranged horizontal ribs each having one end connected to the vertical rib; a plurality of buttons each connected to the other end of an associated one of the horizontal ribs, and slidably fitted in an associated one of the button holes; and comb-shaped flow guide rib members each arranged around an associated one of the buttons, and adapted to guide water, penetrating the button hole associated with the associated button, downward along a predetermined flow path, each of the comb-shaped flow guide rib members comprising ribs extending upward from an upper edge of the associated button, and ribs extending downward from a lower edge of the associated button.

Vertically-adjacent ones of the flow guide rib members may be vertically spaced apart from each other by a predetermined distance.

In another aspect of the present invention, a button assembly of a control panel assembly comprises: a control panel provided with a plurality of button holes; a printed circuit board fixedly mounted to a rear surface of the control panel; a vertical rib attached to the control panel; a plurality of vertically-arranged horizontal ribs each having one end connected to the vertical rib; a plurality of buttons each connected to the other end of an associated one of the horizontal ribs, and slidably fitted in an associated one of the button holes; flow guides each arranged around an associated one of the buttons; and comb-shaped flow guide rib members each arranged around an associated one of the flow guides, and adapted to guide water, penetrating the button hole associated with the associated flow guide, downward along a predetermined flow path, each of the comb-shaped flow guide rib members comprising ribs extending upward from an upper edge of the associated flow guide, and ribs extending downward from a lower edge of the associated flow guide.

Vertically-adjacent ones of the flow guide rib members may be vertically spaced apart from each other by a predetermined distance.

In another aspect of the present invention, a button assembly of a control panel assembly comprises: a control panel provided with a button hole; a printed circuit board fixedly mounted to a rear surface of the control panel; a vertical rib attached to the control panel; a horizontal rib having one end connected to the vertical rib; a button connected to the other end of the horizontal rib, and slidably fitted in the button hole; and a flow guide arranged around the button to extend downward to a position vertically spaced apart from an inner bottom surface of the control panel by a predetermined distance.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
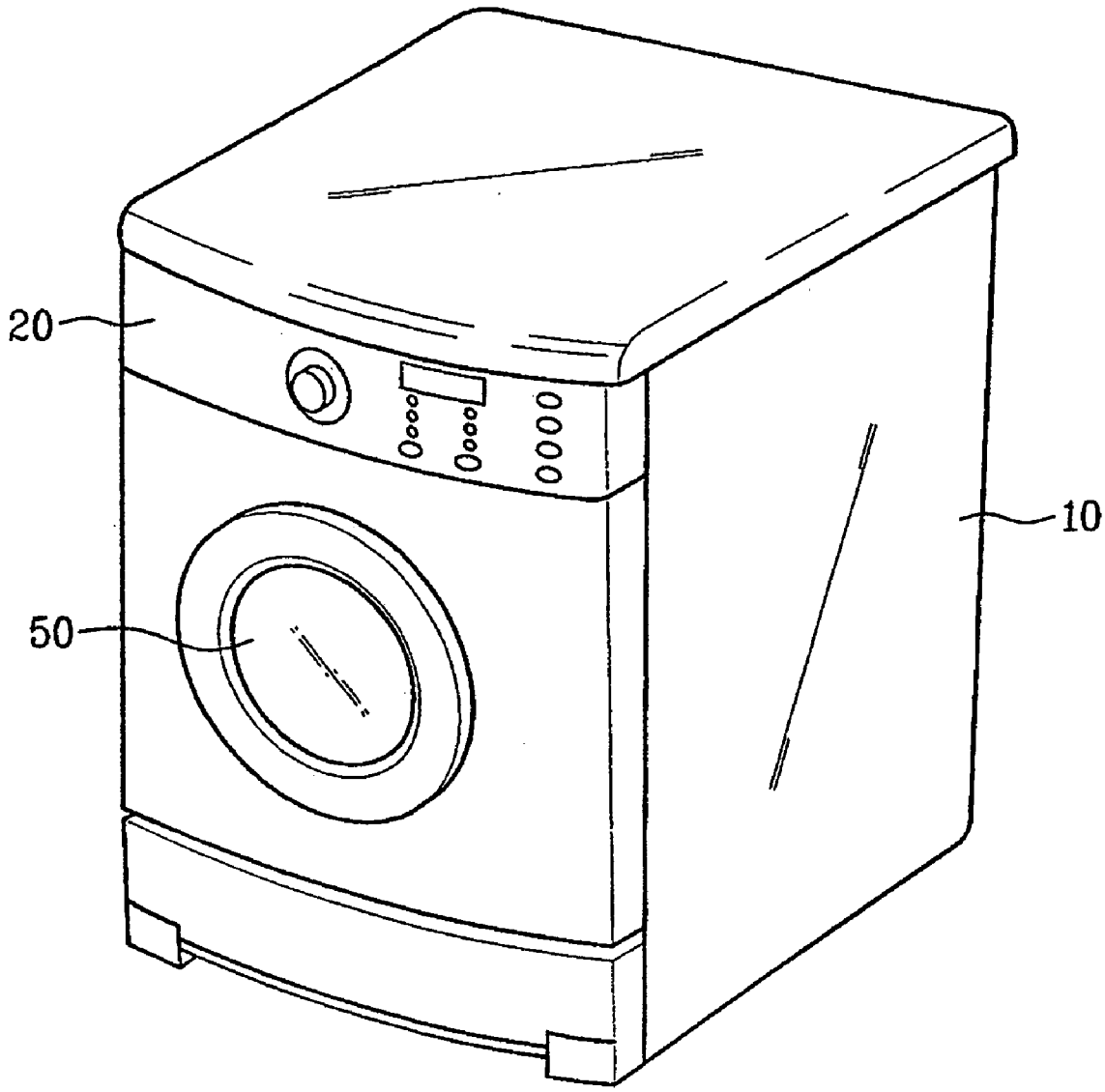
FIG. 1 Related Art
FIG. 1 is a perspective view schematically illustrating the outer appearance of a general drum washing machine.
Figure 2:
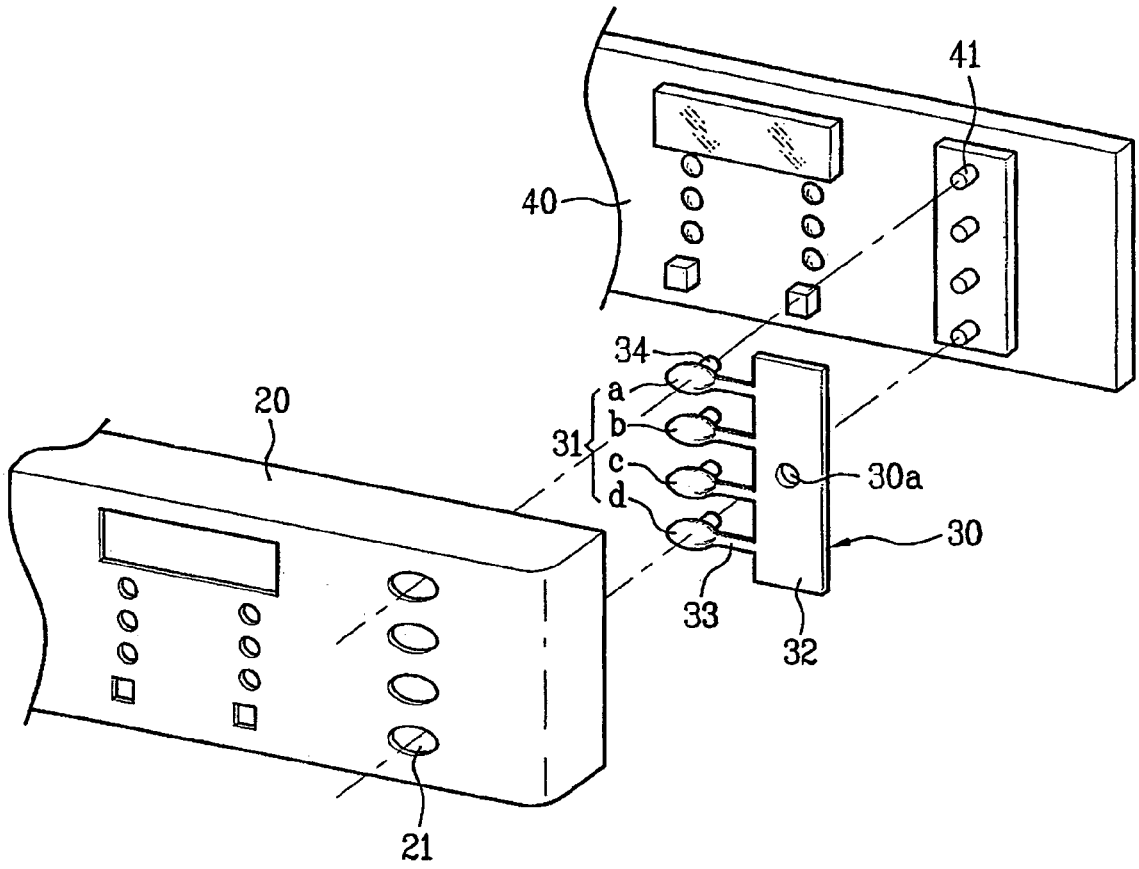
FIG. 2 Related Art
FIG. 2 is an exploded perspective view illustrating a conventional control panel assembly included in the drum washing machine of FIG. 1.
Figure 3:
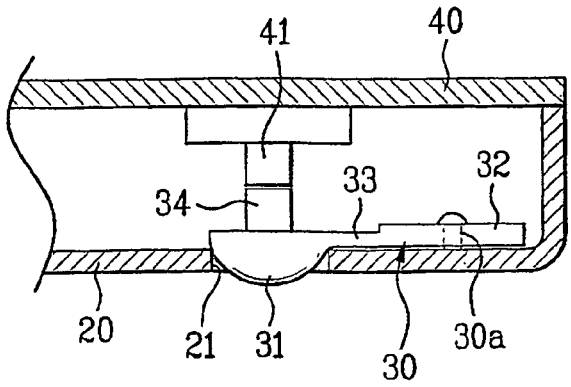
FIG. 3 Related Art
FIG. 3 is a sectional view illustrating an assembled state of the control panel assembly shown in FIG. 2.
Figure 4:
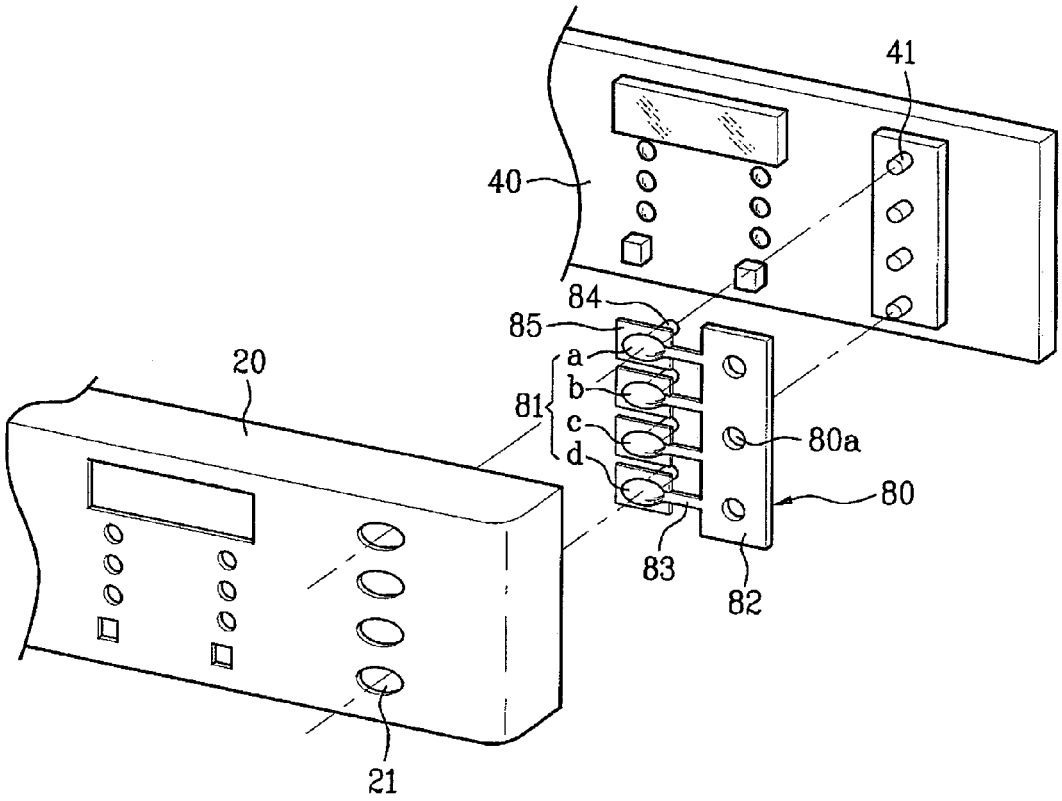
FIG. 4 is a perspective view illustrating a control panel assembly and a button assembly included in the control panel assembly in accordance with the present invention.

Hereinafter, a button assembly of a control panel assembly according to a first embodiment of the present invention will be described with reference to FIG. 4. As shown in FIG. 4, the button assembly according to the first embodiment of the present invention, which is designated by reference numeral "80" includes a control panel 20 provided with a plurality of button holes 21, and a PCB 40 fixedly mounted to a rear surface of the control panel 20. The button assembly 80 also includes a vertical rib 82 attached to the control panel 20, a plurality of vertically-arranged horizontal ribs 83 each having one end connected to the vertical rib 82, a plurality of buttons 81 each connected to the other end of an associated one of the horizontal ribs 83, and slidably fitted in an associated one of the button holes 21, and flow guides 85 each arranged around an associated one of the buttons 81 to surround the associated button 81, and adapted to guide water, penetrating the button hole 21 associated with the associated button 81, downward along a predetermined flow path.

In the case illustrated in FIG. 4, each flow guide 85 surrounding the associated button 81 has a rectangular plate structure. Accordingly, when water attached to one of the buttons 81 upon an operation of pressing the button 81 penetrates along the button hole 21 associated with the pressed button 81, the penetrated water flows downward while being sequentially transferred to the buttons 81 arranged beneath the pressed button 81 along the rectangular-plate-shaped flow guides 85 respectively arranged around buttons 81.

Figure 5:
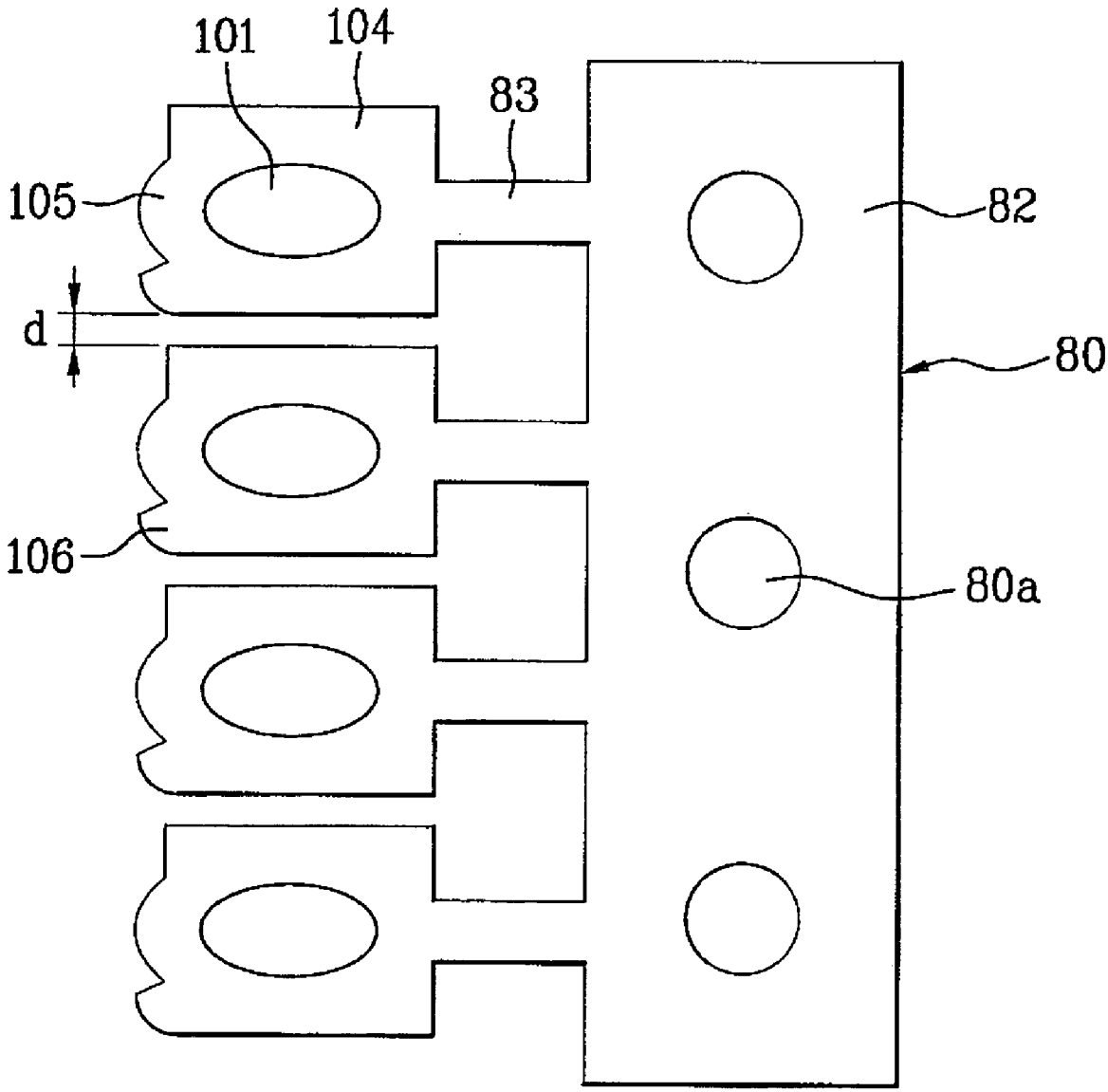
FIGS. 5 to 8 are front views illustrating various button assemblies according to various embodiments of the present invention, respectively.
Figure 6:
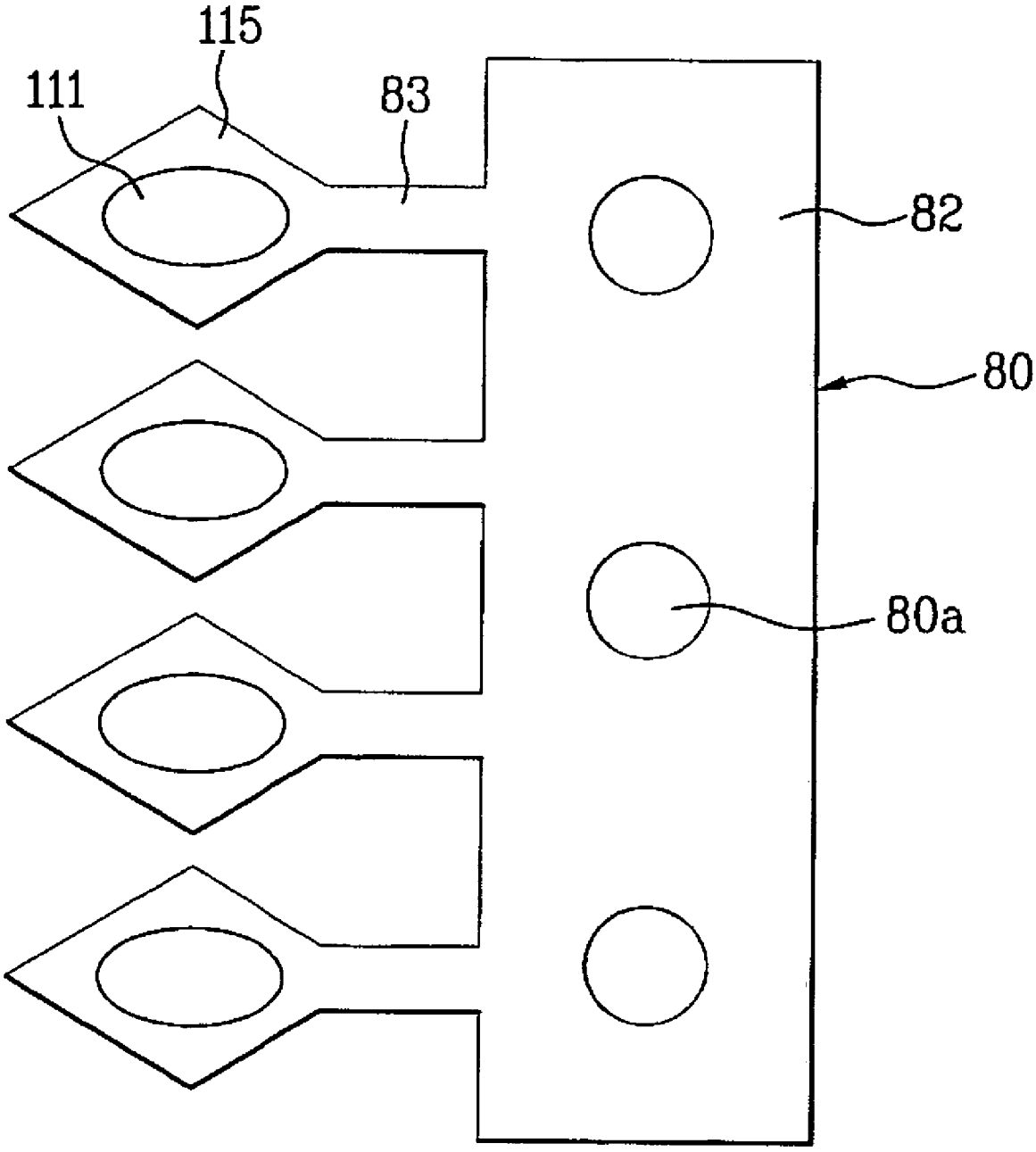
Figure 7:
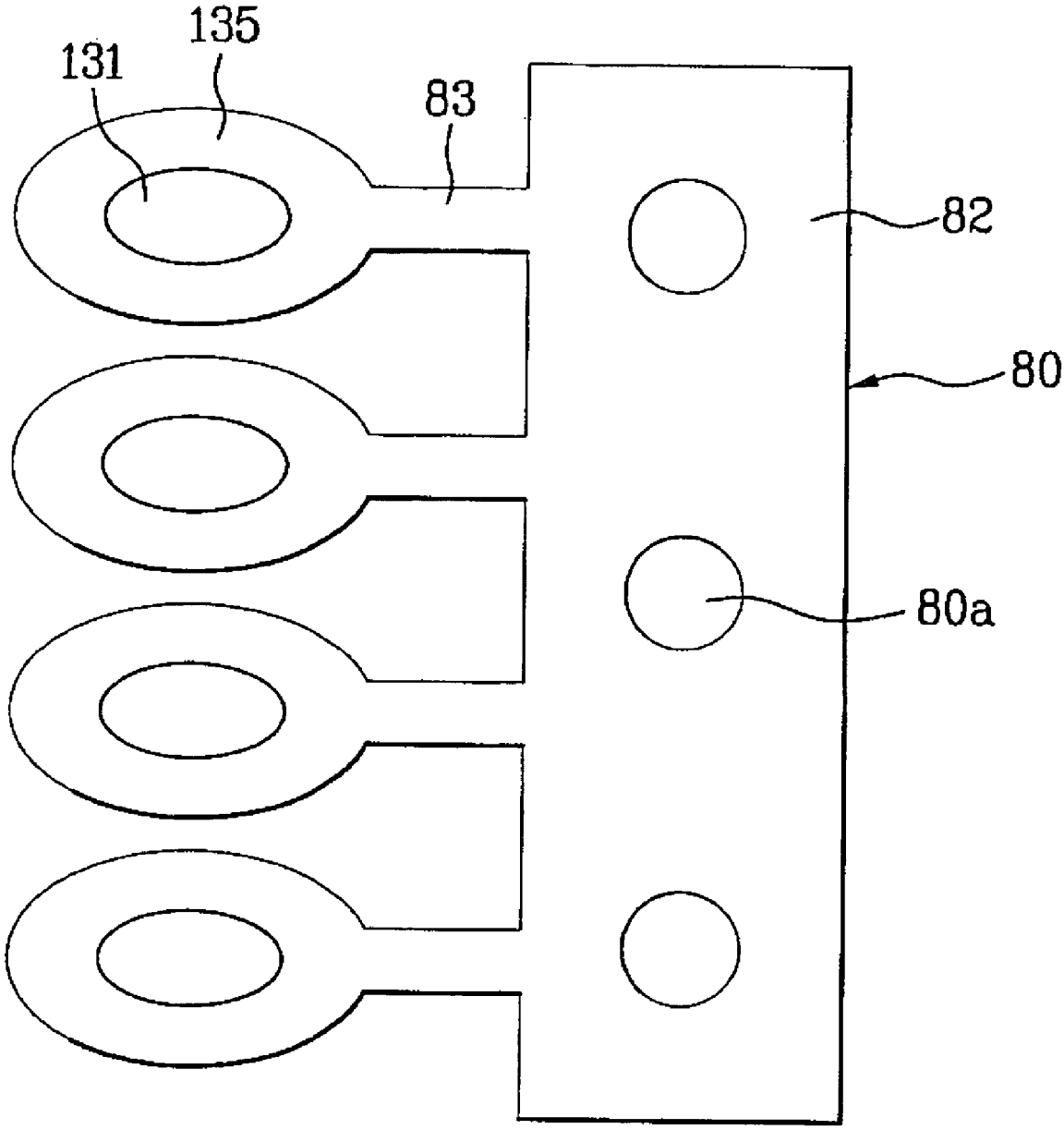

Meanwhile, the flow guides 85 may have diverse structures other than the rectangular plate shape, as shown in FIGS. 5 to 7. Referring to FIG. 5, flow guides 105 are illustrated which have a structure different from the rectangular plate structure of FIG. 4. As shown in FIG. 5, each flow guide 105 includes a plate-shaped body, a rectangular upper auxiliary plate portion 104 connected to an upper end of the plate-shaped body, and a lower auxiliary plate portion 106 connected to a lower end of the plate-shaped body. The lower auxiliary plate portion 106 has one end having a round surface. Each flow guide 105 may have a structure in which the lower auxiliary plate portion 106 has the same shape as the rectangular shape of the upper auxiliary plate portion 104.

Referring to FIG. 6, flow guides 115 are illustrated which have a diamond plate structure. Also, referring to FIG. 7, flow guides 135 are illustrated which have an oval plate structure. Although not shown, the plate-shaped flow guides may have a circular shape.

Vertically-adjacent ones of the flow guides 85 are vertically spaced apart from each other by a predetermined distance, as shown in FIG. 4. Similarly to the case of FIG. 4, the vertically-adjacent flow guides in each of the cases having a flow guide structure different from that of FIG. 4 are vertically spaced apart from each other by a predetermined distance. The distance is designated by reference character "d" in FIG. 5. It is preferred that the distance d be about 1 to 5 mm, in order to cause water to be naturally downwardly transferred along the flow guides.

Figure 8:
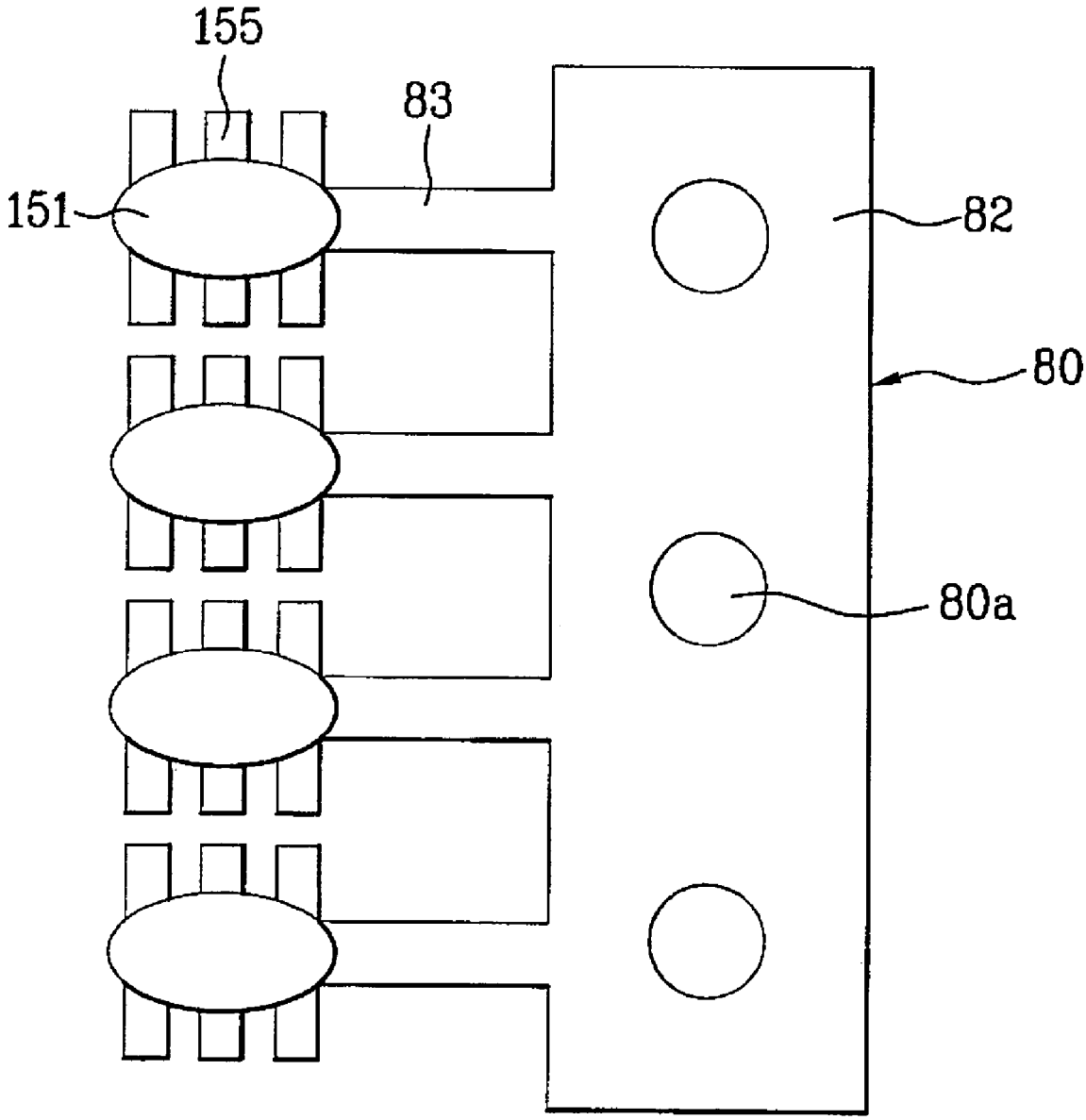

Referring to FIG. 8, a button assembly of a control panel assembly according to a second embodiment of the present invention is illustrated. In accordance with the second embodiment of the present invention, as shown in FIG. 8, the button assembly includes a vertical rib 82 attached to a control panel (designated by "20" in FIG. 4), a plurality of vertically-arranged horizontal ribs 83 each having one end connected to the vertical rib 82, and a plurality of buttons 151 each connected to the other end of an associated one of the horizontal ribs 83, and slidably fitted in an associated one of button holes (designated by "21" in FIG. 4) of the control panel 20. The button assembly also includes comb-shaped flow guide rib members 155 each arranged around an associated one of the buttons 81, and adapted to guide water, penetrating the button hole 21 associated with the associated button 81, downward along a predetermined flow path. Each comb-shaped flow guide rib member 155 includes ribs extending upward from an upper edge of the associated button 81, and ribs extending downward from a lower edge of the associated button 81.

Similarly to the first embodiment, vertically-adjacent ones of the comb-shaped flow guide rib members 155 are vertically spaced apart from each other by a predetermined distance in accordance with the second embodiment.

Although not shown, a button assembly of a control panel assembly, in which the flow guide structure of the first embodiment and the comb-shaped flow guide rib structure of the second embodiment are combined, may be implemented in accordance with a third embodiment of the present invention. In accordance with the third embodiment, the button assembly includes flow guides each arranged around an associated one of the buttons 81 to surround the associated button 81, and comb-shaped flow guide rib members each arranged around an associated one of the flow guides, in order to guide water, penetrating the button hole 21 associated with the associated button 81, downward along a predetermined flow path. In this case, each comb-shaped flow guide rib member includes ribs extending upward from an upper edge of the associated flow guide, and ribs extending downward from a lower edge of the associated flow guide.

Figure 9:
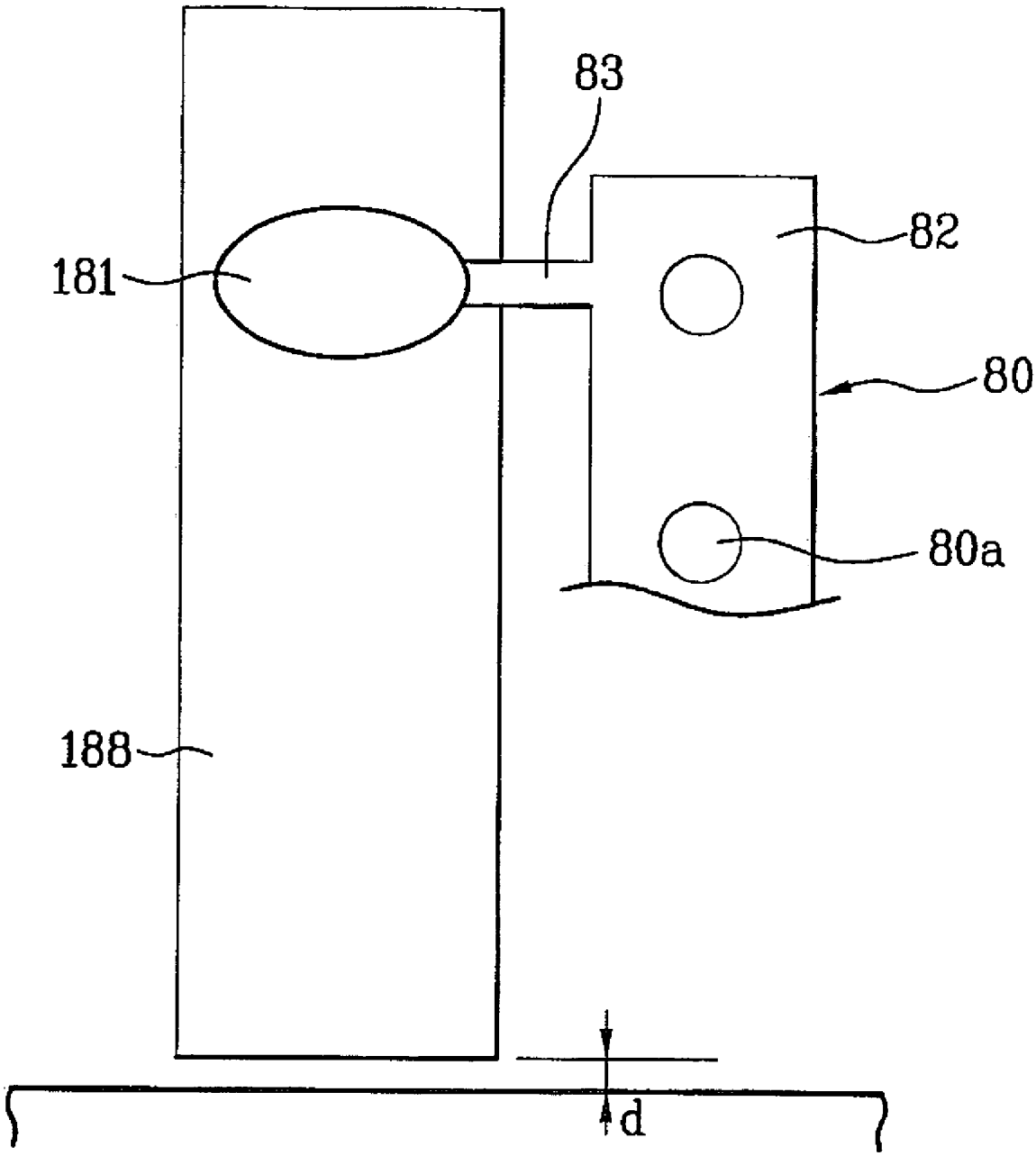
FIG. 9 is a front view illustrating a button assembly according to another embodiment of the present invention.

Meanwhile, FIG. 9 illustrates a fourth embodiment of the present invention applied to a button assembly including a single button. In accordance with the fourth embodiment, as shown in FIG. 9, the button assembly 80 includes a vertical rib 82 attached to a control panel (designated by "20" in FIG. 4), a horizontal rib 83 having one end connected to the vertical rib 82, and a button 181 connected to the other end of the horizontal rib 83, and slidably fitted in a button hole (designated by "21" in FIG. 4) of the control panel 20.

The button assembly 80 also includes a flow guide 188 arranged around the button 181 to extend downward to a position vertically spaced apart from an inner bottom surface of the control panel 20 by a predetermined distance d. In this case, it is preferred that the distance d between the lower end of the flow guide 188 and the inner bottom surface of the control panel 20 be about 1 to 5 mm, similarly to the above-described cases.

Hereinafter, functions of the button assemblies having the above-described structures according to respective embodiments of the present invention will be described. For simplicity, the following description will be given mainly in conjunction with the case of FIG. 4.

When the user presses a selected one of the buttons 81 using his finger under the condition in which the finger is wet, water on the finger may penetrate into the interior of the control panel 20 via the button hole 21 corresponding to the pressed button 81. In this case, the water penetrating the button hole 21 is downwardly transferred in a sequential manner along the flow guides 85 respectively formed around the pressed button 81 and the buttons 81 arranged beneath the pressed button 81. That is, the penetrated water is guided to flow downward along the flow guides 85 in a sequential manner to the lower portion of the control panel 20, without being quickly and directly dropped. Accordingly, it is possible to prevent the penetrated water from splashing.

In the flow guides of FIGS. 5 to 7, which have diverse plate-shaped structures different from the plate-shaped structure of FIG. 4, effects similar to the above-described effect obtained by the flow guides of FIG. 4 are obtained. Also, in the button assembly 80 of FIG. 8, which includes the flow guide rib members 155, the same effect as that of the first embodiment is obtained because the penetrated water is downwardly transferred along the flow guide rib members 155.

Similarly, in the case of the button assembly including the single button 181, as shown in FIG. 9, it is possible to stably transfer the penetrated water to the inner bottom surface of the control panel 20 along the flow guide 188 because the flow guide 188 has a plate structure vertically spaced apart from the inner bottom wall of the control panel 20 by the predetermined distance d.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A button assembly of a control panel assembly for a laundry appliance comprising:

the control panel provided with a plurality of button holes, wherein the control panel is mounted on the laundry appliance in a substantially vertical direction;

a printed circuit board fixedly mounted to a rear surface of the control panel;

a vertical rib attached to the control panel;

a plurality of vertically-arranged horizontal ribs each having one end connected to the vertical rib;

a plurality of buttons each connected to the other end of an associated one of the horizontal ribs, and slidably fitted in an associated one of the button holes; and flow guides each adapted to guide water, penetrating an associated one of the button holes, downward along a predetermined vertical flow path, wherein the flow guides are vertically spaced apart from each other by a predetermined distance thereby preventing the penetrated water from splashing.

2. The button assembly according to claim 1, wherein each of the flow guides is arranged around an associated one of the buttons to surround the associated button, and has a plate-shaped structure.

3. The button assembly according to claim 2, wherein vertically-adjacent ones of the flow guides are vertically spaced apart from each other by a predetermined distance.

4. The button assembly according to claim 3, wherein the predetermined distance is 1 to 5 mm.

5. The button assembly according to claim 2, wherein each of the flow guides comprises a plate-shaped body, and a pair of rectangular auxiliary plate portions respectively connected to upper and lower ends of the plate-shaped body.

6. The button assembly according to claim 2, wherein each of the flow guides comprises a plate-shaped body, a rectangular upper auxiliary plate portion connected to an upper portion of the plate-shaped body, and a lower auxiliary plate portion connected to a lower portion of the plate-shaped body, the lower auxiliary plate portion having one end having a round surface.

7. The button assembly according to claim 2, wherein the plate-shaped structure of each flow guide has a rectangular shape.

8. The button assembly according to claim 2, wherein the plate-shaped structure of each flow guide has a circular shape.

9. The button assembly according to claim 2, wherein the plate-shaped structure of each flow guide has an oval shape.

10. The button assembly according to claim 2, wherein the plate-shaped structure of each flow guide has a diamond shape.

11. The button assembly according to claim 1, wherein the penetrated water is sequentially transferred to an adjacent flow guide along the flow path.

12. A button assembly of a control panel assembly comprising:

a control panel provided with a plurality of button holes;

a printed circuit board fixedly mounted to a rear surface of the control panel;

a vertical rib attached to the control panel;

a plurality of vertically-arranged horizontal ribs each having one end connected to the vertical rib;

a plurality of buttons each connected to the other end of an associated one of the horizontal ribs, and slidably fitted in an associated one of the button holes; and comb-shaped flow guide rib members each arranged around an associated one of the buttons, and adapted to guide water, penetrating the button hole associated with the associated button, downward along a predetermined flow path, each of the comb-shaped flow guide rib members comprising ribs extending upward from an upper edge of the associated button, and ribs extending downward from a lower edge of the associated button.

13. The button assembly according to claim 12, wherein vertically-adjacent ones of the flow guide rib members are vertically spaced apart from each other by a predetermined distance.

14. The button assembly according to claim 13, wherein the predetermined distance is 1 to 5 mm.

15. A button assembly of a control panel assembly comprising:

a control panel provided with a plurality of button holes;

a printed circuit board fixedly mounted to a rear surface of the control panel;

a vertical rib attached to the control panel;

a plurality of vertically-arranged horizontal ribs each having one end connected to the vertical rib;

a plurality of buttons each connected to the other end of an associated one of the horizontal ribs, and slidably fitted in an associated one of the button holes;

flow guides each arranged around an associated one of the buttons; and comb-shaped flow guide rib members each arranged around an associated one of the flow guides, and adapted to guide water, penetrating the button hole associated with the associated flow guide, downward along a predetermined flow path, each of the comb-shaped flow guide rib members comprising ribs extending upward from an upper edge of the associated flow guide, and ribs extending downward from a lower edge of the associated flow guide.

16. The button assembly according to claim 15, wherein vertically-adjacent ones of the flow guide rib members are vertically spaced apart from each other by a predetermined distance.

17. The button assembly according to claim 16, wherein the predetermined distance is 1 to 5 mm.

18. A button assembly of a laundry appliance control panel assembly comprising:

the control panel provided with a button hole, wherein the control panel is mounted on the laundry appliance in a substantially vertical direction;

a printed circuit board fixedly mounted to a rear surface of the control panel;

a vertical rib attached to the control panel;

a horizontal rib having one end connected to the vertical rib;

a button connected to the other end of the horizontal rib, and slidably fitted in the button hole; and a flow guides adapted to guide water, arranged around the button to extend downward to a position vertically spaced apart from an inner bottom surface of the control panel by a predetermined distance thereby preventing penetrated water from splashing.

19. The button assembly according to claim 18, wherein the predetermined distance is 1 to 5 mm.

20. The button assembly according to claim 18, wherein the penetrated water is sequentially transferred to an adjacent flow guide before the water reaches the inner bottom surface of the control panel.

* * * * *